United States Patent [19]

Yuda

[11] 4,167,134

[45] Sep. 11, 1979

[54] COMPACT FLUID ACTUATOR

[76] Inventor: Lawrence F. Yuda, 3030 Jeanne Dr., Parma, Ohio 44134

[21] Appl. No.: 772,989

[22] Filed: Feb. 28, 1977

[51] Int. Cl.[2] ..... F01B 11/02; F15B 15/22

[52] U.S. Cl. ..... 91/405; 91/409; 92/85 B; 92/128; 92/163

[58] Field of Search ..... 92/85 B, 163, 128; 285/305; 91/405, 407, 408, 409

[56] References Cited

U.S. PATENT DOCUMENTS

| | | | |
|---|---|---|---|
| 723,025 | 3/1903 | Resor | 92/85 R |
| 802,104 | 10/1905 | Howard | 92/85 R |
| 2,222,819 | 11/1940 | Light | 91/396 |
| 2,510,314 | 6/1950 | Jirsa | 92/85 B |
| 2,645,513 | 7/1953 | Sterrett | 285/305 X |
| 2,714,522 | 8/1955 | Becker | 92/128 X |
| 2,886,005 | 5/1959 | Bryan | 92/163 X |
| 2,935,051 | 5/1960 | Fuller et al. | 92/85 B |
| 2,985,140 | 5/1961 | Fagge | 92/168 X |
| 3,136,230 | 6/1964 | Buckley | 92/128 |
| 3,465,650 | 9/1969 | Gluck | 92/85 R |
| 3,559,538 | 2/1971 | Holder | 92/85 B |

*Primary Examiner*—Irwin C. Cohen
*Attorney, Agent, or Firm*—Alfred D. Lobo

[57] ABSTRACT

A compact, double-acting piston-type fluid activated device having an axially reciprocable piston for controlled, predetermined deceleration of the piston as it approaches the limit at each end of its travel within a cylindrical bore. The cylindrical bore is sealed at each end by end walls removably retained in the bore. Each end wall is provided with a central counterbore in its inner surface which in cooperation with the piston provides a cushioning chamber. The area of the counterbore central surface is critically related to the circular cross-sectional area of the cylindrical bore in which the end wall is to be secured, being in the range from about 60% to about 85% thereof. A vent passage places the cushioning chamber in preselectedly restricted flow communication with porting means in the wall of the device, each port being located intermediate the end walls. A method is provided for removably circumferentially locking each end wall in the operating cylinder with a wire snap ring having a hooked end. The method allows the end walls to be secured within, and later removed from a heavy-walled device.

4 Claims, 5 Drawing Figures

COMPACT FLUID ACTUATOR

BACKGROUND OF THE INVENTION

This invention relates to fluid operated piston-type actuators commonly referred to as fluid actuators. More particularly, this invention relates to a compact fluid actuated device having a cylindrical bore fitted with an axially reciprocable piston in a cylindrical bore, including means for controlling deceleration of the piston as it approaches the limit at each end of its travel within the cylindrical bore. Fluid, whether liquid or gas, to operate the device is supplied at a relatively low pressure in the range from about 1 to about 1000 psig, alternately to chambers on each side of the piston, and vented from the chambers, through ports in communication with the cylindrical bore. Fluid actuators of the type to which this invention is related are described in the art in U.S. Pat. Nos. 3,136,228; 3,303,756; 3,043,639; 2,673,130; and, 3,559,538 inter alia. The actuators are used to provide movement responsive to the application of hydraulic or pneumatic pressure alternately to one and then the other side of the reciprocable piston within the cylindrical bore. Typically, an operating shaft connected at one end to the piston and movable therewith, extends axially from the cylindrical bore and is drivingly engaged with a mechanism which benefits from the force exerted by the operating shaft. Normally, fluid actuators, particularly those in which the frequency of reciprocation of the piston is in the range from about 1 to about 100 cycles/min., are provided with some means for decelerating the piston as it nears the terminal portion of its stroke. These deceleration means, referred to as "snubbers" provide controlled deceleration to prevent damage associated with continual impact of the piston against the end walls of the fluid actuator. Snubbers may absorb impact by means of a fluid cushion which may be adjustable in relation to the energy to be absorbed; or, snubbers may be mechanical, relying on an elastomer material to absorb impact.

Deceleration is conventionally provided in a hydraulic cylinder by trapping a portion of the hydraulic fluid being discharged from the cylinder by the movement of the piston towards one sealed end of the cylinder, and causing the fluid to pass through a restricted orifice to convert the kinetic energy to heat.

As acknowledged in U.S. Pat. No. 3,559,538, deceleration means existing prior to this invention were complex in nature and required either separately formed passages in the operating cylinder, non-metallic seals exposed to substantial pressure differentials, assemblages of separate elements, or check valves in the discharge line. As a result, machining and assembly procedures were complex and functional weaknesses prevalent.

Moreover, in many prior art deceleration means, accurate control of the size of the restricting orifice, both during machining of the actuator components and during operation, was extremely difficult. As a result, desired deceleration rates were difficult to establish and maintain. A typical example of a solution to this problem is illustrated by the commonly used deceleration means which includes a buffer chamber associated with the operating cylinder, and a buffer piston assiciated with the movable piston. The diametrical clearance between the buffer chamber and buffer piston establishes the restricting orifice size, and rigid control of manufacturing and assembly tolerances is necessary to provide desired performance. In another design approach to solve this problem, each end wall or cylinder head of an operating cylinder is provided with annular interior and exerior grooves in which elastomer O-rings are held. The term "operating cylinder" is used herein to refer to the body of the device in which the cylindrical bore is provided, whether the body is a right cylinder or a rectangular parallelepiped. The operating shaft is slidably disposed within the interior O-ring which provides a cushion seal. The operating cylinder is also provided with a radial passage aligned with and in restrictedly open communication with the cushion seal by virtue of a recessed pressure adjusting means threadedly disposed in the operating cylinder head. Because each such conventional cylinder head is ported, and includes grooves for the O-rings and a groove for a circumflex square wire key, the head is necessarily thick, generally being about an inch thick, or more.

It is also noteworthy that in prior art fluid actuators in which an operating cylinder is provided with end walls retained by a square wire circumscribing the end wall, the wall of the operating cylinder is necessarily relatively thin. The cylinder wall is thin to allow the square wire to be threaded from outside the cylinder, through the wall and into an annular groove in the circumferential surface of each end wall. If the wall is thick, the square wire cannot be so threaded. The thin cylinder wall limits the pressure under which the cylinder may be operated. Further, as explained hereinabove, because most prior art end walls are necessarily at least of sufficient thickness to permit provision of a threaded port, the additional length of the overall device due to the thick end walls negates use of the device in many applications where compactness is essential, as is often the case with "clamping cylinders", and actuators for feeding small parts for assembly.

The present invention is a novel and surprisingly effective compact double-acting fluid actuated device having ports intermediate the end walls, which includes a deceleration means and thin end walls without the practical disadvantages of prior art devices. The deceleration means of the present invention does not require mechanical snubber means, check valves in the discharge conduit, separately formed elements associated with the piston or cylinder, or non-metallic seals exposed to extreme pressure differentials. It provides control of the piston deceleration rate while minimizing the complexity of providing and maintaining a restricted orifice flow path of desired size. By avoiding a mechanical snubber which is variably and unpredictably compressible, my compact fluid actuator provides a precise stroke in an operating cylinder which is only slightly longer than the length of its stroke. The actuator is termed "compact" because the overall length of the operating cylinder is determined by the thickness of the end walls selected for use under predetermined operating pressure rather than the diameter of the ports to be provided therein; and, the overall length is generally only slightly more than the length of the stroke.

SUMMARY OF THE INVENTION

It is a general object of this invention to provide a relatively thick-walled, double acting fluid actuator which may be constructed with thin end walls and ports intermediate the end walls. Each port is in unrestricted, directly linear open communication with the cylindrical bore of the actuator.

It is also an object of this invention to provide relatively thin end walls, the innerfaces of which are recessed to provide a fluid cushion chamber, also referred to as a cushion chamber, which is vented through a vent passage. The vent passage places the fluid cushion chamber in preselectedly restricted open communication with an annular passage formed by a beveled circumference of each end wall and a planar circumferential surface of the piston in cooperation with the cylindrical bore of the actuator.

It is a specific object of this invention to provide a double acting fluid actuator in which the power of each stroke in either direction is substantially the same, and the speed at which the piston commences its travel from each end wall is essentially the same as the average velocity of the piston, by virtue of a recess provided in the inner face of each end wall; it is essential that the area of the recess be in the range from about 60 percent to about 85 percent of the cross-sectional area of the cylindrical bore in which the end wall is to be fitted.

It is also a specific object of this invention to provide a method for removably locking a relatively thin circular end wall in each end of a relatively thick walled operating cylinder by utilizing a circumflex square wire snap ring, also referred to as a feed-wire, having a hooked end and a linear end. The method of securing the circular end wall in the end of the cylindrical bore of the actuator comprises inserting the end wall in the bore sufficiently to provide access to a tangential anchor passage bored in the wall of the operating cylinder, threading the linear end of the ring through the anchor passage so that the linear end emerges from the outer surface of the cylinder, inserting the hook shaped end of the snap ring into a spanner slot in the end wall which is disposed so that the slot is adjacent the anchor passage, rotating the end wall with a spanner through one revolution while drawing in the snap ring between the end wall and the wall of the operating cylinder, and anchoring the linear end of the snap ring in the anchor passage.

It is another specific object of this invention to provide a double-acting pneumatic actuator which may be operated with fluid pressure in the range from about 1 psig to about 1000 psig at a frequency in the range from about 1 to about 120 cycles/minute.

It is still another specific object of this invention to provide an essentially silent double-acting fluid actuator which protects the hearing of persons using it, and extends the life of the equipment to which it is connected because it operates without a jarring impact or substantial vibration. The device is quiet and vibration-free because it is predeterminedly cushioned with fluid as it nears the limit of each stroke, and precludes adjustments by an operator using the device.

These and other objects and advantages of the invention will be appreciated and better understood by reference to the following detailed description when considered in connection with the accompanying drawings.

DETAILED DESCRIPTION OF THE PREFERRED EMBODIMENT

The present invention may be embodied in numerous fluid-actuated piston and cylinder devices usable in a variety of environments as a source of portable power. The particular fluid actuator of my invention is double acting, may be operated either hydraulically or pneumatically under a pressure in the range from about 1 psig to about 1000 psig, at relatively low frequency in the range from about 0 to about 120 cycles/minute, without a jarring impact at the end of each stroke, and without substantial vibration. It is not a vibrator. The fluid actuator may be single-ended or double-ended, and is most desirable in those situations where space to mount the actuator is limited, particularly when the space is only slightly more than the stroke of the device. Normally, the operating cylinder of the actuator associated with relatively movable machine members is rigidly secured to one of the machine members and the outer end of the operating shaft or piston rod is connected to the other machine member, there being no substantial side thrust. In the following description, solely for convenience in reference, the terms "inner" and "outer", "upper" and "lower", "outwardly" and "inwardly" are used to refer to directions toward and away from the geometric center of the cylinder, and designated parts thereof, as will be readily apparent.

Figure 1:
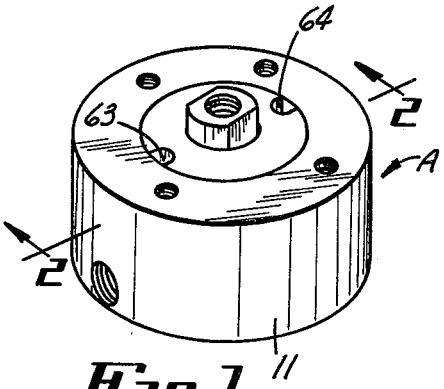
FIG. 1 is a perspective view, diagrammatically illustrating a cylindrical fluid actuator of this invention.

Referring now to the drawings, and particularly to FIG. 1, there is shown by way of example a perspective view of a double-acting, single-ended fluid actuator referred to generally by reference letter "A", which embodies the present invention. The actuator A is rigidly secured in a suitable manner to the frame (not shown) of a machine in which the actuator is to be used. The actuator A comprises a right circular cylindrical member referred to as an operating cylinder 11, having a finished cylindrical bore 12 therein. The operating cylinder 11 may be of arbitrary shape and is commonly a rectangular parallelpiped. The term "operating cylinder" is used herein to refer to any body of an actuator in which a cylindrical bore is provided. As seen by reference to FIG. 2 which is an elevation cross-section view along line 2—2 in FIG. 1, the actuator A is provided with end walls 13 and 14 which are secured within the bore 12, at opposite ends thereof by wire retainer 15 and 16, as will be explained more fully hereinafter. Each end wall is devoid of port means through which fluid may be introduced, from a source of pressurized fluid outside the cylinder, into the cylinder for a working stroke, or expelled from the cylinder to a reservoir outside the cylinder during retraction. The circumferential wall of the piston head 17 is provided with a peripheral groove 24 in which an elastomer O-ring 25, or other suitable compressible sealing means is fitted for sealing engagement against the interior wall of the operating cylinder 11. The diameter of the piston head 17 is chosen so as to be snugly but slideably fitted in the bore 12.

End wall 14 is a right cylinder, referred to as a right cylindrical disc because it is generally thin, snugly but slideably fitted in the bore 12; the outer surface of the end wall 14 is provided with a pair of diametrically opposite spanner slots 26 and 27. The thickness of the end wall is chosen in relation to the operating pressure of the fluid actuator and the strength of the material from which the end wall is made. Typically, the end wall is more than about 0.5 cm. thick and is provided with a pair of annular grooves 28 and 29 in parallel spaced apart relationship in the circumferential wall of the end wall 14. The inner groove 29 is fitted with an elastomer O-ring 31, disposed therein for sealing engagement against the interior surface of the bore 12. The outer groove 28 is adapted to snugly but slideably accommodate a portion of a square wire key; the groove 28 is generally U-shaped in profile with vertical sidewalls. The outer groove 28 communicates with the spanner slots 26 and 27, the bottom of each slot being coplanar with the inner vertical side wall of groove 28. The outer groove 28 is fitted with a wire retainer 16 of rectangular cross-section, also referred to as a square wire key, which serves to removably secure the end wall 14 in the bore 12, as is explained immediately hereinbelow.

Figure 3:
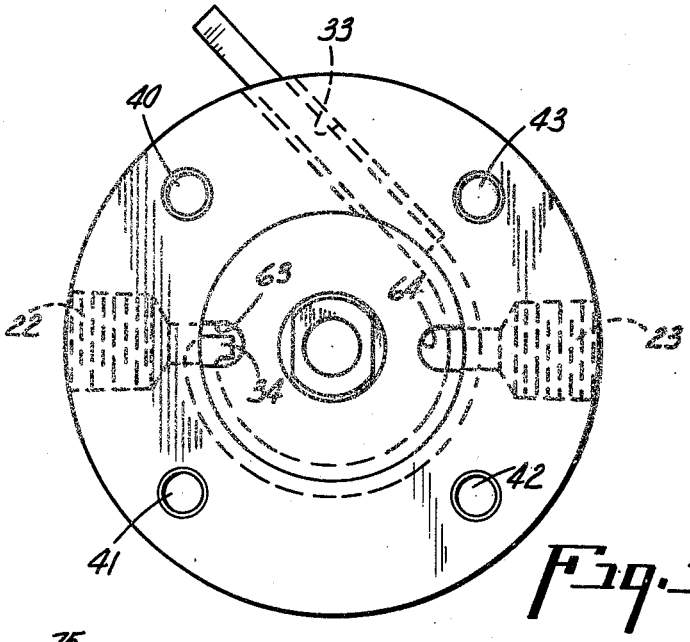
FIG. 3 is a plan view of the top of the fluid actuator illustrated in FIG. 1.

Referring now to FIG. 3, there is shown an end view of fluid actuator A, wherein the wall of the operating cylinder 11, near one end, is provided with a bore 33, referred to as an anchor passage, which is in tangential communication with bore 12. The inner wall of the operating cylinder 11 is provided with a U-shaped circumferential groove 35 to snugly but slideably accommodate a portion of the square wire key 16, and the groove 35 communicates with the anchor passage 33, so that the square wire key can be drawn into the groove 35, through anchor passage 33, which slideably accommodates the square wire key 16. The key 16 is inserted and anchored in place by the following novel method.

To begin with, a preselected length of wire key stock sufficient to encircle the end wall 14 is cut, and one end is bent to form a hook 34, the other end remaining linear. The end wall 14, fitted with O-ring 31, is then pressed into the bore 12 sufficiently to align approximately and adjacently dispose the slot 26 and the anchor passage 33. The linear end of the wire key 16 is then inserted in the inner end of the anchor passage 33 and pushed radially outwardly until substantially its whole length emerges from the outer wall of the cylinder 11, and the hook 34 can be lodged in slot 26. A spanner is then inserted in the slots 26 and 27 and the end wall is rotated clockwise as seen in FIG. 3 to draw the wire key 16 into and between the annular groove 28 and an annular groove 35 provided in the inner wall of the cylinder 11, near one end, thus locking the end wall in the bore 12. The end wall 14 is rotated through a complete revolution so that the wire key essentially completely encircles the end wall and the linear end is anchored in the anchor passage 33. Mounting holes 40, 41, 42 and 43 are provided to mount the cylinder 11 as desired.

It will now be apparent that by virtue of the spanner slots in communication with the annular keyway formed by annular grooves 28 and 35, and the manner in which the square wire is drawn in, an end wall may be secured in position irrespective of the wall thickness of the cylinder 11. It will also be apparent that, were a wire key inserted without a hooked end from outside the cylinder, by inserting one end of the wire inwardly through the cylinder wall into a radial cavity provided in the end wall, the thickness of the cylinder wall must necessarily be thin, or the wire would be damaged.

Figure 4:
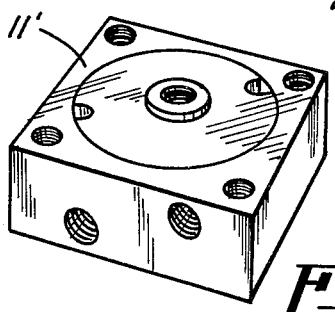
FIG. 4 is a perspective view, diagrammatically illustrating a rectangular parallelepiped fluid actuator of this invention.

Referring further to FIG. 3, it is seen that ports 22 and 23 are conically necked down to neck passages 36 and 37 respectively. Each neck passage is located so as to duct fluid directly linearly to the inner face of end wall 14. When the operating cylinder is a right cylinder as illustrated by FIG. 1, each port and neck passage conducts fluid radially directly to the inner face of each end wall; when cylinder 11' is a rectangular parallelepiped, as illustrated by FIG. 4, each port and neck passage conducts fluid, linearly to the inner face of each end wall, the fluid flowing through the neck passage in a direction at right angles to the direction of axial movement of the piston. Typically a neck passage is about 1/16 in. in diameter even in a cylinder having a cylindrical bore 12 of only about 1 in., thus ensuring essentially unrestricted flow of fluid through the neck passage. With large cylindrical bores, neck passages of larger diameter may be used.

Figure 2:
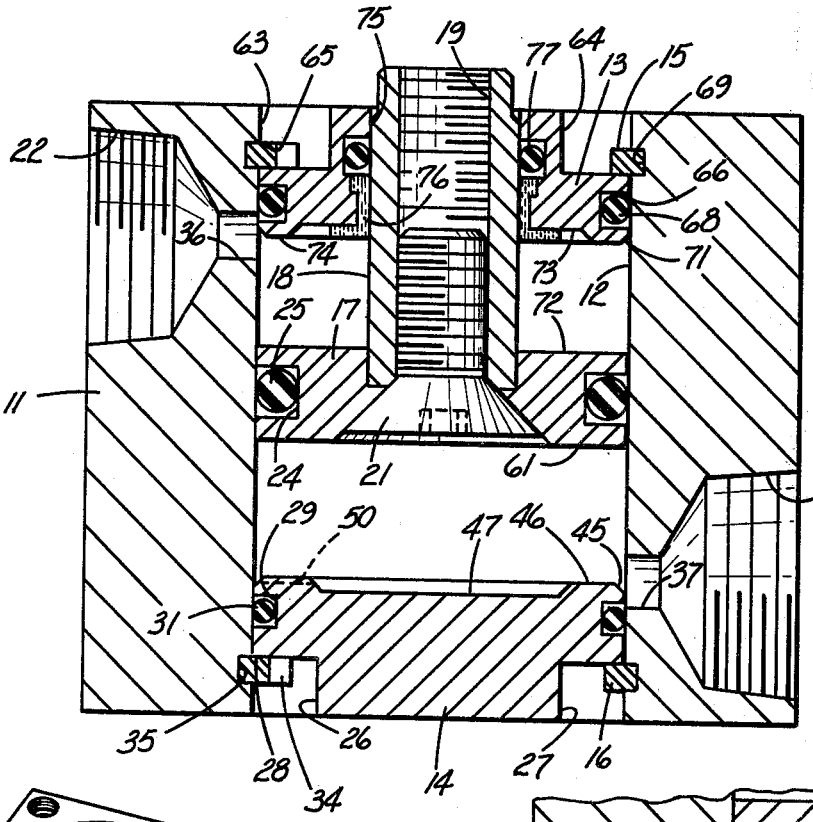
FIG. 2 is an elevation cross-section view along line 2—2 of FIG. 1.

Reverting now to FIG. 2, it is seen that the inner face of the end wall 14, in cooperation with the lower transversely planar face 61 of piston head 17 and the cylindrical bore 12, define a working chamber W. The circumference 45 of the inner face of end wall 14 is beveled at an angle of from about 30° to about 50°, and preferably at about 45°. The inner face is also centrally counterbored to provide an annular boss 46 and a recessed central surface 47. It has been found that the area of the recessed central surface 47 must be from about 60 percent to about 85 percent of the circular cross sectional area of the cylindrical bore 12 in which the end wall is to be secured, to avoid erratic movement of the piston. By "circular cross sectional area" I refer to the area of the cross section of the bore 12 in a plane orthogonal to the longitudinal axis of the bore. It is most preferred to have the recessed central area about 75 percent of the area of the bore in which the end wall is fitted.

Figure 5:
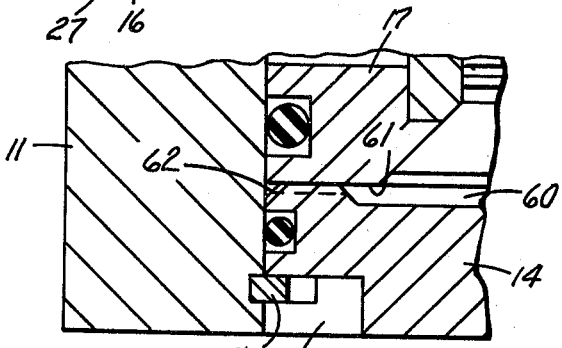
FIG. 5 is a detailed cross-section elevation view of a portion of the actuator with its piston head at the end of its stroke, and fully retracted.

The annular boss 46 is provided with a radial vent passage 50, shown in one side of end wall 14 in FIG. 2. When the piston head is retracted so that its lower surface 61 is in abutment against the annular boss 46, the recessed central portion 47 of the inner face and the lower surface 61 of the piston head define a cushioning chamber 60 as illustrated in FIG. 5. The depth of the recess is not critical, the depth being selected to trap enough fluid to provide a cushioning effect. In general a depth in the range from about 0.020 in. to about 0.125 in. is found satisfactory. The lower surface 61 and the cylindrical bore 12, in cooperation with beveled circumference 45 of the annular boss 46, define an annular chamber 62 having a generally wedge-shaped cross section, in open fluid communication with the neck passage 37. The vent 50 places the cushion chamber 60 in open communication with the annular chamber 62. The width and depth of the vent passage 50 is so chosen that fluid trapped in the cushion chamber 60 as the piston head nears the end of its stroke, is vented over a short period of time sufficient to avoid a jarring impact of the piston head against the end wall. The dimensions of the vent 50 are arrived at by considering the type of fluid used, the operating pressure of the actuator, the frequency of piston reciprocation, the stroke of the actuator, and the conditions under which the actuator is to be used, inter alia. Optimum dimensions of the vent are arrived at by simple experimentation. Typically each vent passage may be from about 0.020 in. to about 0.0625 in. wide. It may be as deep as the annular boss 46 is high, depending upon how much the annular boss is raised from the transversely planar recessed central surface 47 of the end wall. It will be evident that more than one vent passage may be provided if desired, and that the vent passages may be of arbitrary shape so long as they provide the necessary venting in a predetermined period of time. Typically, where a single vent passage is used, it is provided at a location diametrically opposite to the neck passage 37 to get the benefit of the time required to force fluid vented from the cushion chamber through the maximum length of annular chamber, before the fluid is ejected. Plural vents may be provided, also for preselectedly restricted flow communication.

The annular chamber 62 also provides an unexpectedly beneficial function at the commencement of the working stroke of the piston head, when fluid under pressure is introduced through neck passage 37. By virtue of the wedge-shape of the annular chamber, entering fluid instantaneously forces the lower surface 61 of the piston head 17 away from the annular boss 46, to commence the working stroke of the piston head. Further, when fluid has entered the annular chamber 62, the passage 50 allows fluid to enter the recessed central surface 47 of the end wall to assist in the start-up of movement of the piston 17. As soon as the piston head is displaced, fluid rushes into the working chamber W supplying full power to the piston head.

Referring now to the upper end of the fluid actuator, and particularly to end wall 13, there is shown a right cylindrical disc, of sufficient thickness for the contemplated service conditions, snugly but slideably fitted in the bore 12. The outer surface of the end wall 13 is provided with a pair of diametrically opposite spanner slots 63 and 64, and, as in end wall 14, with annular grooves 65,66, for a square wire key 15 and an elstomer O-ring 68, respectively. The end wall is secured in the bore 12 with a wire key 15 drawn into groove 65 and an annular groove 69 provided in the upper end of the cylinder 11, in a manner analogous with that described hereinabove for end wall 14.

The inner face of the end wall 13, like the inner face of end wall 14, is provided with a centrally counterbored recessed surface 73 which must leave an annular boss 74 having an area in the range from about 15 percent to about 40 percent of the circular cross section of the cylindrical bore 12. There extends through end wall 13 a stepped axial bore 75 which at its inner end is adapted to snugly retain a permanently lubricated bushing or a split nylon bushing 76 through which operating shaft 18 is slideably axially movable. At the upper end of the bore 75 there is provided an annular groove in which an elastomer O-ring 77 is disposed for sealing engagement with the outer surface of shaft 18. The upper lip of the bore 75 slideably accommodates the shaft 18.

The circumference of the annular boss 74 is provided with a bevel 71 to define a circumferential annular chamber (not shown) in cooperation with the inner walls of the cylinder 11 and the transversely planar upper surface 72 of piston head 17, this annular chamber being in open communication with neck passage 36, in a manner analogous to that described hereinabove for the end wall 14. Again, the retraction of the piston head, after it reaches the end of its working stroke, is instantaneously effected due to the wedge-shape of the annular chamber.

It will be apparent that, because of the cross sectional area of the operating shaft 18, the area of the upper surface 72 of the piston head 17 available to generate fluid power is proportionately less. Therefore, where maintaining maximum power during retraction of the piston head is essential, the diameter of the operating shaft is reduced to a minimum.

The simplicity of the design of this compact cylinder permits unexpected savings in manufacture, at the same time assuring maximum reliability, ruggedness, and quiet vibration-free operation. The fluid actuator may be disassembled by the simple expedient of rotating each end wall with a spanner, and removing the wire key securing it. Worn parts may then be replaced, and the fluid actuator reassembled.

We claim:

1. A compact air operated piston-type double-acting actuator, for operation with essentially no side thrust, comprising an operating cylinder having a longitudinal cylindrical bore and inlet-exhaust ports; end walls removably secured within said cylindrical bore, near each end thereof, and in fluid-tight engagement therewith, each of said end walls being devoid of air port means for placing said bore in fluid communication with a reservoir of air outside said cylinder, and each end wall having a counterbored central recess in its inner face to provide an annular boss having a circumferential bevel on the outside surface of said boss, said central recess having an area in the range from about 60 percent to about 85 percent of the cross-sectional area of said cylindrical bore; a reciprocable piston disposed in said cylindrical bore, said piston being movable in response to air pressure acting thereon, compressible sealing means disposed between said piston and said cylinder, an operating shaft extending outwardly through one of said end walls; and air cushioning means for decelerating said piston as it approaches the limit at each end of its travel within said cylindrical bore, including a cushion chamber defined by a transverse planar surface of said piston in abutment against said annular boss of each end wall, and a vent passage in said annular boss, said vent passage placing said cushion chamber in directly linear preselectedly restricted fluid communication with an inlet-exhaust port in said operating cylinder, wherein said inlet-exhaust port is disposed adjacent an end wall and is at least partially blocked as said piston moves towards said annular boss.

2. The compact fluid operated actuator of claim 1 wherein each said end wall and said piston at the limit of its stroke forms an annular chamber defined by said circumferential bevel, the periphery of said piston and the wall of said cylinder, and said annular chamber in directly abutting fluid communication with said fluid port.

3. The compact air operated actuator of claim 2 wherein each said end wall is removably secured by wire key means slideably circumferentially inserted in cooperating annular key grooves provided in said end wall and said wall of said cylinder devoid of separate anchoring means for said wire key means.

4. The compact fluid actuator of claim 3 wherein said end wall is provided with a pair of diametrically opposite spanner slots in the outer surface thereof, and said slots are in open communication with the annular key groove provided in said end wall.

* * * * *